US012082653B2

(12) United States Patent
Kim

(10) Patent No.: US 12,082,653 B2
(45) Date of Patent: Sep. 10, 2024

(54) DIAL-TYPE WIRE TIGHTENING DEVICE

(71) Applicant: Jung Gon Kim, Gyeongsangnam-do (KR)

(72) Inventor: Jung Gon Kim, Gyeongsangnam-do (KR)

( * ) Notice: Subject to any disclaimer, the term of this patent is extended or adjusted under 35 U.S.C. 154(b) by 31 days.

(21) Appl. No.: 18/028,573

(22) PCT Filed: Aug. 27, 2021

(86) PCT No.: PCT/KR2021/011518
§ 371 (c)(1),
(2) Date: Mar. 27, 2023

(87) PCT Pub. No.: WO2022/065715
PCT Pub. Date: Mar. 31, 2022

(65) Prior Publication Data

US 2023/0354965 A1 Nov. 9, 2023

(30) Foreign Application Priority Data

Sep. 25, 2020 (KR) ..... 10-2020-0124566

(51) Int. Cl.
*A43C 11/16* (2006.01)
*A43C 11/20* (2006.01)

(52) U.S. Cl.
CPC ..... *A43C 11/165* (2013.01)

(58) Field of Classification Search
CPC ..... A43C 11/20; A43C 11/16; A43C 11/165
See application file for complete search history.

(56) References Cited

U.S. PATENT DOCUMENTS

| | | | | |
|---|---|---|---|---|
| 10,993,504 | B1 * | 5/2021 | Li | A43C 11/165 |
| 2015/0313319 | A1 * | 11/2015 | Ha | A43C 11/165 24/712 |
| 2018/0160775 | A1 * | 6/2018 | Pollack | B65H 75/4449 |
| 2019/0343235 | A1 * | 11/2019 | So | A43C 7/08 |
| 2021/0037926 | A1 * | 2/2021 | Kim | A43C 7/08 |

FOREIGN PATENT DOCUMENTS

| | | | |
|---|---|---|---|
| CN | 208403436 | U | 1/2019 |
| JP | 3162969 | U | 9/2010 |
| JP | 2017079831 | A | 5/2017 |
| JP | 2018047267 | A | 3/2018 |
| JP | 2020505090 | A | 2/2020 |
| KR | 101147681 | B1 | 5/2012 |
| KR | 101438572 | B1 | 9/2014 |
| KR | 101661236 | B1 | 9/2016 |
| KR | 101707484 | B1 | 2/2017 |
| KR | 101833680 | B1 | 2/2018 |
| KR | 20180052078 | A | 5/2018 |
| KR | 101954753 | B1 | 3/2019 |
| KR | 20200028701 | A | 3/2020 |
| KR | 20200028846 | A | 3/2020 |

* cited by examiner

*Primary Examiner* — Jack W Lavinder
(74) *Attorney, Agent, or Firm* — Bayramoglu Law Offices LLC

(57) ABSTRACT

A dial-type wire tightening device is provided. The device is capable of being manufactured to be miniaturized and, by widening contact areas between elements provided to prevent reverse rotation when the wire is being tightened, has improved durability. The dial-type wire tightening device includes a lower cover, a reel part, a housing part, an intermediate cover, a stopper unit, a pawl part, and an upper cover.

6 Claims, 6 Drawing Sheets

DIAL-TYPE WIRE TIGHTENING DEVICE

CROSS REFERENCE TO THE RELATED APPLICATIONS

This application is the national phase entry of International Application No. PCT/KR2021/011518, filed on Aug. 27, 2021, which is based upon and claims priority to Korean Patent Application No. 10-2020-0124566, filed on Sep. 25, 2020, the entire contents of which are incorporated herein by reference.

TECHNICAL FIELD

The present disclosure relates to a dial-type wire tightening device. More specifically, the present disclosure relates to a wire tightening device, wherein the device is capable of being manufactured to be miniaturized and, by widening contact areas between elements provided to prevent reverse rotation when the wire is being tightened, has improved durability.

BACKGROUND

In general, a wire tightening device is used to tighten various items and, here, is explained on the basis of the application to shoes among various utilization methods thereof. However, the device may be applied in various ways to items, which are tightened using wires, such as shoes, hats, belts, gloves, bags, hair accessories, and the like.

On the other hand, shoes in the dictionary meaning are collectively referred to as items worn to protect feet when standing or walking on the ground and are classified in various ways depending on purposes. In this case, most shoes are provided with shoelaces to be tightened in order to properly fit the shoes to the feet of each person wearing them.

Specifically, ordinary shoes largely include: an upper provided in a shape to wrap wearer's feet and ankles in an upper part of a shoe; a midsole provided on a lower side of the upper to absorb shocks applied by wearer's walking; and an outsole attached to a bottom surface of the midsole, whereby the shoe is prevented from being slipped while coming into contact with the ground and allowed to be in stable contact with the ground, wherein a tongue configured to protect the instep by preventing it from being sprained is added to the upper, an eyelet stay, which is reinforcing material with a lace hole provided on the front side of the tongue, is provided, and a shoelace, such as a wire, is fastened into the lace hole configured to adjust the shoe to fit the foot.

Of course, shoes should be selected in an appropriate size so that they do not come off when walking. However, shoes are standardized and manufactured to a specific length and width by a uniform mass production method, so it is difficult for a foot width of ready-made shoes to accurately match a foot width of a wearer.

Therefore, in order to be able to walk in a safe and comfortable manner after putting on shoes, a wearer needs to properly pull and tighten the shoelaces so that feet and shoes thereof are in close contact with each other and tie knots to fix the shoelaces after tightening same by hand.

However, in order to pull the shoelace to fit the wearer's foot, a certain amount of tension needs to be applied to the shoelace, and tying a knot on the shoelace requires relatively delicate work, so there is a problem in that it gives inconvenience to the elderly, children, and handicapped people.

In order to get rid of such a problem, a wire tightening device for tightening and loosening the shoelace easily without binding the shoelace to the shoe has been applied, thereby providing convenience when putting on and taking off the shoe.

As disclosed in Korean Patent No. 10-1438572 (Apparatus for fastening wire), a bobbin on which a wire-shaped shoelace is wound is restrained by a stopper unit using a ratchet gear, and when a rotating cover is rotated in one direction, a wire is tightened. When the restraint state of the stopper unit controlling the ratchet is released, the bobbin is free to rotate, so that the shoelace may be unfastened.

A conventional apparatus for fastening a wire having such a configuration is configured to wind the wire on a reel while restraining a ratchet gear rotating in one direction from being rotated in an opposite direction by a pawl of a stopper unit, thereby causing the restraining force to be strongly biased toward the ratchet gear. For example, when a user tightens a shoelace strongly or the shoelace is strongly pulled by a movement of a foot, force to loosen the shoelace is strong, so while the force is biased toward the pawl that restricts a rotation of the ratchet gear, the strong stress is applied to the ratchet gear. Accordingly, there has been a problem in that the ratchet gear and the pawl are worn and easily damaged, and thus the durability thereof is degraded so that the life span of the apparatus is shortened.

In addition, when the shoelace is tightened, the rotating cover is rotated several times to tighten the shoelace, and when the rotating cover is released while being rotated, there may occur that the stopper of the stopper unit that rotates with the rotating cover may not be precisely engaged with the ratchet gear. In this case, the stopper may be pushed back from a cog of the ratchet gear that is in a position the shoelace is desired to be tightened, thereby being engaged with a cog of the ratchet gear that is in a position behind the position desired above. Accordingly, there has been a problem in that the stopper was tightened to be in a state in which tightening force was looser than desired tightening force.

In order to solve such a problem, a shoelace fastening device is disclosed in Korean Patent No. 10-1833680 (Shoelace fastening device) as in the following. A subsidiary ratchet gear, assisting a main ratchet gear and a stopper which are configured to prevent the counter-rotating when the shoestrings are being tightened, to be engaged with each other is set up into the main ratchet gear and stopper, thereby dispersing the operating load biased toward the main ratchet gear. Accordingly, the gear may be prevented from being worn or damaged to improve service life. In addition, the stopper unit is coupled to have a clearance so that the stopper may be accurately engaged in the main ratchet gear, thereby allowing the shoestring not to be dissolved in a tightening process. However, when the device is miniaturized, organic coupling force between each other is weakened due to the size and shape reduction of each of the components, which may cause a decrease in durability. In particular, restraining force provided to rotate in one direction may be lowered, so design changes in the components may be inevitable.

SUMMARY

Technical Problem

Accordingly, the present disclosure has been made keeping in mind the above problems occurring in the related art. The present disclosure is to provide a dial-type wire tightening device, wherein the device is capable of being manufactured to be miniaturized and, by widening contact areas between elements provided to prevent reverse rotation when the wire is being tightened, not only dispersing operating load biased toward a portion to prevent wear or damage of gears but also increasing binding force between components to improve durability.

The objectives of the present disclosure are not limited to the above-mentioned objectives, and other objectives not mentioned may be clearly understood by those skilled in the art from the following description.

Technical Solution

In order to accomplish the above objectives, there may be provided a dial-type wire tightening device, the device including: a lower cover provided with a plate-shaped support plate and provided with an accommodating groove provided in a central portion by a support wall body provided to extend vertically from an upper surface of the support plate; a reel part provided with a gear portion installed in a circle having a cog of a two-stage structure on an inner circumference edge at an upper-end portion, thereby allowing a wire to be wound along an outer circumference edge when rotating by being rotatably installed inside the accommodating groove; a housing part having a lower-end portion coupled and fixed to the accommodating groove, thereby accommodating the reel part therein and provided with a ratchet gear along an inner circumference edge of an upper-end portion; an intermediate cover provided with a coupling groove provided to be recessed upward from a lower surface to allow an upper-end portion of the housing part to be fixedly inserted thereinto and a seating groove provided to be recessed downward from an upper surface, wherein a central hole which the gear portion passes through is provided at a central portion of the seating groove, and an opening is provided by opening a portion of an inner circumferential surface of the seating groove; a stopper unit provided with a stopper coupled with an outer circumferential surface of the gear portion and radially branched off to have elasticity from an outer circumferential surface thereof and a responding ratchet gear provided at a tip of the stopper to be engaged with the ratchet gear through the opening, thereby providing primary restraining force so that the reel part rotates in one direction, wherein the gear portion has a lower-end portion exposed through the central hole by being seated on the seating groove; a pawl part coupled with an upper-end portion of the intermediate cover and provided with a responding gear portion configured to be inserted into the gear portion, thereby providing secondary restraining force so that the reel part rotates in one direction, wherein the responding gear portion has a responding cog of a two-stage structure configured to be engaged with the cog and is installed to protrude downward; and an upper cover coupled with the intermediate cover while wrapping around the outside of same, thereby being rotated integrally with the intermediate cover by rotational force applied from the outside.

At this time, the responding cog may include: a ratchet tooth-typed responding cog portion provided along an outer circumferential surface of an upper-end portion having a cylindrical shape of the responding gear portion; and a bevel tooth-typed responding cog portion provided along an outer circumferential surface of a lower-end portion having a conical shape of the responding gear portion and extending integrally from a tip of the ratchet tooth-typed responding cog portion to be inclined toward a central axis.

In addition, the reel part may be provided with foreign material discharge holes radially disposed with respect to a virtual central axis at a lower-end portion, thereby discharging foreign material deposited on the wire along rotation in one direction of the reel part.

Furthermore, a locking step provided to protrude along an outer circumferential surface may be provided at the upper-end portion of the reel part, and a locking piece extending downward but having a bent end portion may be provided at a lower-end portion of the stopper unit, whereby the locking piece may move up and down while being rubbed against the locking step so that coupling and separation of the stopper unit and the reel part may be confirmed.

In the meantime, the stopper unit may be provided with a shaft bearing protruding downward at the lower-end portion thereof, and the intermediate cover may be provided with a shaft hole coupled with the shaft bearing on a lower surface of the seating groove thereof, wherein the shaft hole may have a long hole shape in which a clearance is provided between it and the shaft bearing so that the stopper unit may move minutely in a clockwise or counterclockwise direction.

In addition, the lower cover may be provided with at least one sewing guide groove to allow accurate sewing to be performed along an edge of the support plate.

Advantageous Effects

There are advantages to a device of the present disclosure, wherein the device is capable of being manufactured to be miniaturized and, by widening contact areas between elements provided to prevent reverse rotation when the wire is being tightened, not only dispersing operating load biased toward a portion to prevent wear or damage of gears but also increasing binding force between components to improve durability.

Figure 1:
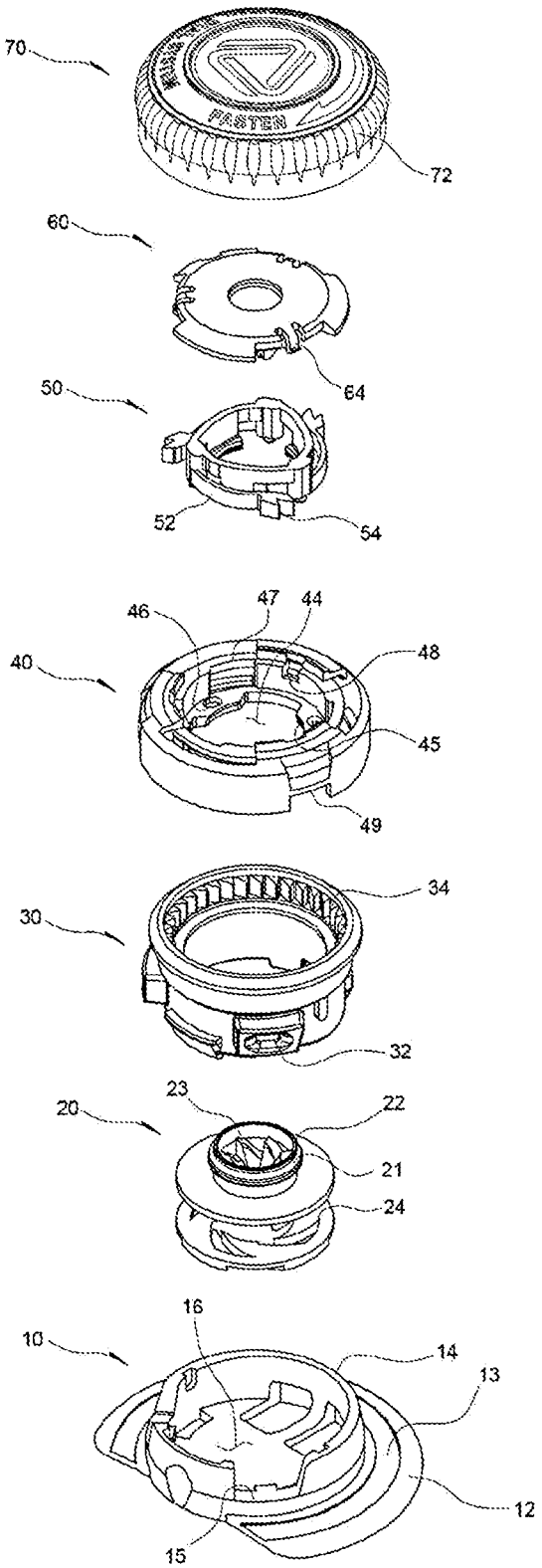
FIG. 1 shows exploded perspective views from a top side of a dial-type wire tightening device according to an exemplary embodiment of the present disclosure.

<Description of the Reference Numerals in the Drawings>

10: lower cover
12: support plate
13: sewing guide groove
14: support wall body
15: recessed groove
16: accommodating groove -continued

| <Description of the Reference Numerals in the Drawings> | |
|---|---|
| 20: reel part | |
| 21: locking step | 22: gear portion |
| 23: cog | 23a: ratchet tooth-typed cog portion |
| 23b: bevel tooth-typed cog portion | 24: foreign material discharge holes |
| 30: housing part | |
| 32: wire inlet | 34: ratchet gear |
| 40: intermediate cover | |
| 42: coupling groove | 44: seating groove |
| 45: central hole | 46: shaft hole |
| 47: opening | 48: settling hole |
| 49: locking recessed groove | |
| 50: stopper unit | |
| 51: locking piece | 52: stopper |
| 54: responding ratchet gear | 56: shaft bearing |
| 60: pawl part | |
| 62: responding gear portion | 63: responding cog |
| 63a: ratchet tooth-typed responding cog portion | 63b: bevel tooth-typed responding cog portion |
| 64: settling protrusion | |
| 70: upper cover | |
| 72: non-slip groove | 74: locking protrusion |
| 80: wire | |

DETAILED DESCRIPTION OF THE EMBODIMENTS

Advantages and features of the present disclosure, and methods of achieving same, will become clear with reference to the detailed description of the following embodiments taken in conjunction with the accompanying drawings. However, the present disclosure is not limited to the embodiments disclosed below but will be implemented in various different forms. However, the present embodiments only make the disclosure of the present disclosure complete and are provided to fully inform those of common knowledge in the art to which the present disclosure belongs the scope of the invention, and the present disclosure is only defined by the scope of the claims.

With reference to the accompanying drawings below, specific details for the practice of the present disclosure will be described in detail. Like reference numbers refer to like elements, regardless of drawing, and "and/or" includes each of the recited items and every combination of one or more of the recited items.

Terms used in the present specification are for describing the embodiments and are not intended to limit the present disclosure. In the present specification, singular forms also include plural forms unless specifically stated otherwise in a phrase. As used herein, "includes" and/or "including" does not exclude the presence or addition of one or more other elements other than the recited elements.

Unless otherwise defined, all terms (including technical and scientific terms) used in the present specification may be used in a meaning commonly understood by those of ordinary skill in the art to which the present disclosure belongs. In addition, terms defined in commonly used dictionaries are not interpreted ideally or excessively unless specifically defined explicitly.

Hereinafter, exemplary embodiments of the present disclosure will be described in detail with reference to the accompanying drawings.

Figure 2:
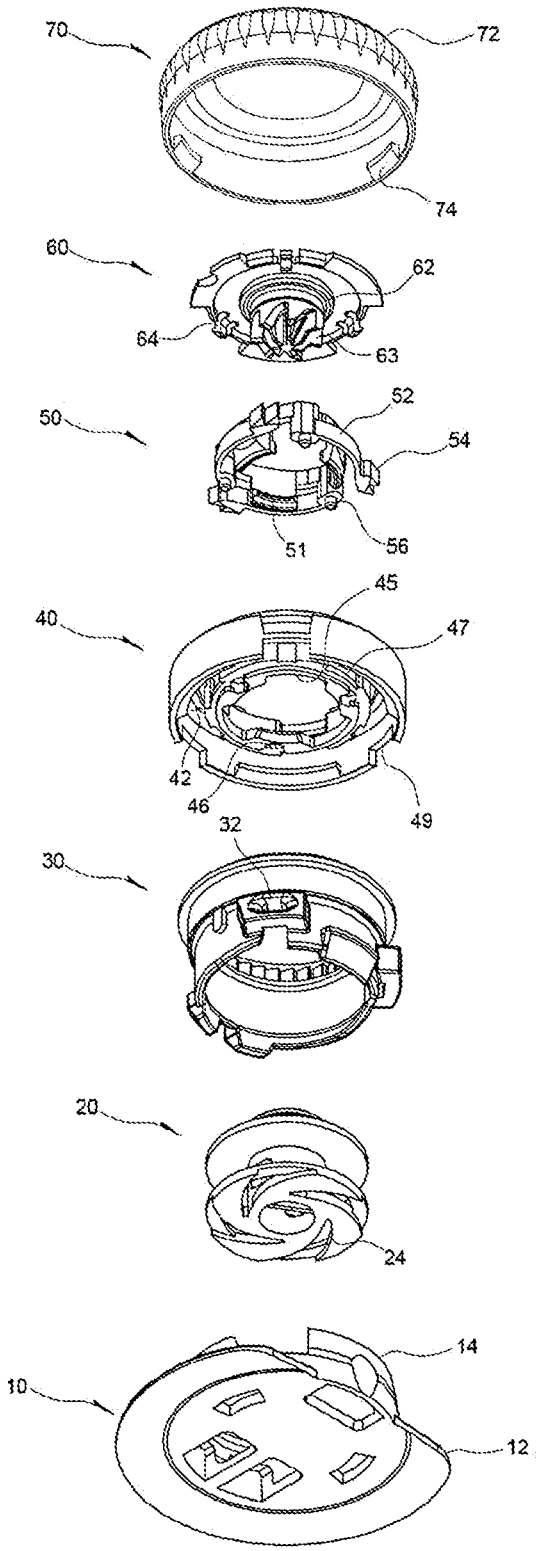
FIG. 2 shows exploded perspective views from a bottom side of the dial-type wire tightening device according to the exemplary embodiment of the present disclosure.

FIG. 1 shows exploded perspective views from a top side of a dial-type wire tightening device according to an exemplary embodiment of the present disclosure, and FIG. 2 shows exploded perspective views from a bottom side of the dial-type wire tightening device according to the exemplary embodiment of the present disclosure.

As shown in FIGS. 1 and 2, a dial-type wire tightening device according to the exemplary embodiment of the present disclosure largely includes a lower cover 10, a reel part 20, a housing part 30, an intermediate cover 40, a stopper unit 50, a pawl part 60, and an upper cover 70.

First, the lower cover 10 supports the wire tightening device as a whole by being sewn to an upper of a shoe. Specifically, the lower cover 10 is provided with a plate-shaped support plate 12, and a support wall body 14 is provided to extend vertically from an upper surface of the support plate 12, whereby an accommodating groove 16 in which the reel part 20 is accommodated is provided in a central portion.

At this time, at least one sewing guide groove 13 may be provided in order to perform accurate sewing along an edge of the support plate 12. Here, the sewing guide groove 13 serves as a guide so that workers may accurately sew along a sewing line when sewing the wire tightening device at the shoe manufacturing site and, by making the attached state of the wire tightening device clean and tidy, may improve the product value of the shoes on which the device is installed.

Next, the reel part 20 is rotatably installed in the accommodating groove 16 and is provided in a cylindrical shape provided with disk-shaped flanges at the upper and lower-end portions. Accordingly, a wire 80 used as a shoelace is wound along the outer circumferential edge when the reel part 20 is rotated.

At this time, a lead-out hole (not shown), into which the wire is inserted and bound in a state in which opposite ends of the wire 80 are knotted, is provided on one side of the body of the reel part 20.

In addition, a gear portion 22 in which a two-stage cog 23 is installed in a circle on an inner circumference edge is provided at an upper-end portion of the reel part 20, and the gear portion 22 is coupled with the pawl part 60 to be described later.

In addition, on the flange constituting the lower-end portion of the reel part 20, foreign material discharge holes 24 radially arranged with respect to a virtual central axis are provided, thereby providing a passage to allow foreign substances deposited on the wire 80 to be discharged to the outside of the wire tightening device along the one-way rotation of the reel part 20.

On the other hand, the housing part 30 has a cylindrical shape with open top and bottom surfaces, and in a state where the reel part 20 is accommodated therein, the lower-end portion is coupled and fixed to the accommodating groove 16, thereby allowing the reel part 20 not to be separated from the wire tightening device in the left and right directions by rotating.

At this time, a wire inlet 32 is provided in the lower portion of the housing part 30 so that the wire 80 may be installed inside the wire tightening device, and the wire inlet 32 is seated and fixed to a recessed groove 15 of the lower cover 10.

In addition, the housing part 30 is provided with the ratchet gear 34 along an inner circumference edge of the upper-end portion thereof, wherein the ratchet gear 43 is engaged with the stopper unit 50 to be described later to allow the wire tightening device to be able to rotate in only one direction.

Next, the intermediate cover 40 is rotatably coupled with the upper-end portion of the housing part 30 to transfer rotational force to the reel part 20 and at the same time, is configured to allow the reel part 20 not to deviate upward from the housing part 30. In addition, the intermediate cover 40 is installed to be able to move up and down from the upper-end portion of the housing part 30 to a predetermined height, thereby allowing the reel part 20 and the stopper unit 50 to be bound and separated.

Specifically, a coupling groove 42 provided to be recessed upward from the lower surface of the intermediate cover 40 is provided, so the upper-end portion of the housing part 30 is pulled in and bound, and at the same time, a seating groove 44 provided to be recessed downward from the upper surface of the intermediate cover 40 is provided, thereby providing an installation space for the stopper unit 50.

In addition, a central hole 45 through which the gear portion 22 passes is provided in a central portion of the seating groove 44, and a portion of the inner circumferential surface of the seating groove 44 is opened so that an opening 47 is provided to allow the ratchet gear 34 of the housing part 30 and the stopper unit 50 to contact each other.

On the other hand, the stopper unit 50 is seated on the seating groove 44 so that each end closely supports the inner circumferential edge of the upper-end portion of the housing part 30, thereby playing a role of providing the primary restraining force so that the wire tightening device rotates in only one direction.

Here, at least one stopper 52 radially branched off from an outer circumferential surface of the stopper unit 50 of an annular shape may be provided to have elasticity, and a responding ratchet gear 54 may be provided at a tip of the stopper 52 and configured to be engaged with the ratchet gear 34 through the opening 47. As a result, the reel part 20 may be maintained to be in a state of being restrained in order to be rotated in one direction.

At this time, a locking piece 51 extending downward but having a bent end portion is provided at a lower-end portion of the stopper unit 50 and is hooked and fixed to the locking step 21 protruding along the outer circumferential surface of the upper-end portion of the reel part 20 so that the reel part 20 and the stopper unit 50 to enable mutual binding.

In addition, the locking piece 51 is provided to have elasticity so as to move up and down while being rubbed against the locking step 21, thereby allowing the coupling and separation operation of the stopper unit 50 and the reel part 20 to be performed in a manner with discipline and accuracy. In particular, through a sound generated when the locking piece 51 goes over riding the locking step 21, the coupling and separation of the stopper unit 50 and the reel part 20 may be easily checked.

Next, the pawl part 60 is coupled with the upper-end portion of the intermediate cover 40 to provide an upper surface of the intermediate cover 40, and at the same time, a responding gear portion 62 protruding downward from a lower surface of the pawl part 60 is inserted into the gear portion 22 to be coupled with each other. Accordingly, secondary restraining force is provided so that the reel part 20 rotates in one direction along the intermediate cover 40.

At this time, a responding cog 63 having a two-stage structure responding to the cog 23 are provided on the outer circumferential surface of the responding gear portion 62, and the responding gear portion 62 is inserted into the gear portion 22, and then the responding cog 63 and the cog 23 are engaged with each other, thereby providing additional restraining force so that the reel part 20 does not rotate in reverse. Through this, the load biased toward the ratchet gear 34 and the responding ratchet gear 54 may be reduced when the wire 80 is being wound, thereby preventing wear or damage of the gear teeth caused by repeated rotation of the wire tightening device and increasing the durability of the wire tightening device.

In addition, a plurality of settling protrusions 64 is provided to protrude from the outer circumferential edge of the pawl part 60 in a form having elasticity, and each of the settling protrusions 64 is detachably coupled with a settling hole 48 provided on an upper surface of the intermediate cover 40, thereby allowing the pawl part 60 to be easily fixed and separated from the intermediate cover 40.

On the other hand, the upper cover 70 is coupled to wrap the outside of the intermediate cover 40 which is in a state in which the pawl part 60 is coupled, to protect other components at the top of the wire tightening device and, at the same time, plays a role of transferring rotational force by being gripped by the wearer.

Here, the upper cover 70 may be provided with a hollow space recessed upward from a lower surface, wherein the upper-end portion of the intermediate cover 40 may be inserted into and fixed to the hollow space, and rotated integrally with the intermediate cover 40 by the rotational force applied from the outside.

At this time, a locking protrusion 74, which is a shape responding to the locking recessed groove 49 formed on the outer circumferential surface of the intermediate cover 40, is provided to protrude on the inner circumferential surface of the upper cover 70. Here, the locking protrusion 74 may be fittingly coupled with the locking recessed groove 49, thereby allowing the upper cover 70 to be rotated integrally with the intermediate cover 40.

In addition, non-slip grooves 72 are provided on the outer circumferential surface of the upper cover 70 at regular intervals along the circumference. Therefore, when the wearer grips the upper cover 70 in order to apply the rotational force, an occurrence of slipping may be prevented.

Figure 3:
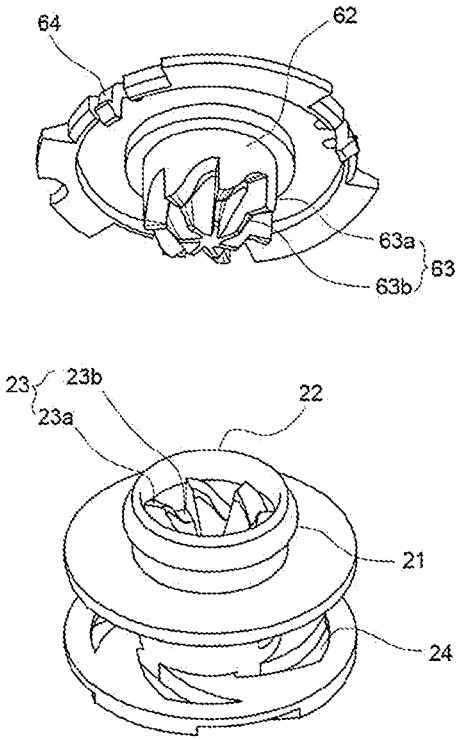
FIG. 3 shows developed perspective views showing a reel part and a pawl part of the dial-type wire tightening device according to the exemplary embodiment of the present disclosure.

FIG. 3 shows developed perspective views showing a reel part and a pawl part of the dial-type wire tightening device according to the exemplary embodiment of the present disclosure.

Providing restraining force to the reel part 20 through mutual coupling of the gear portion 22 and the responding gear portion 62 in order to prevent reverse rotation of the wire tightening device has already been disclosed in many related arts. However, the more the wire tightening device is miniaturized, the more it is difficult to secure sufficient space for coupling or separation of the gear portion 22 and the responding gear portion 62 due to the size and shape reduction of the components. In particular, structural precision is required due to the reduction in the size of the cog 23 and the responding cog 63, so the organic coupling force between same is weakened and the restraining force provided to rotate the same in one direction may be reduced. Therefore, as shown in FIG. 3, in the dial-type wire tightening device of the present disclosure, the responding gear portion 62 is inserted into and coupled with the inside of the gear portion 22. In this case, the cog 23 and the responding cog 63 each have a two-stage structure, thereby allowing the binding force to increase by increasing the contact area therebetween.

Specifically, the cog 23 is provided on the inner circumferential surface of the cylindrical gear portion 22 having an open top surface but includes a ratchet tooth-typed cog portion 23*a* provided along the inner circumferential surface of the upper-end portion of the gear portion 22 and a bevel tooth-typed cog portion 23*b* provided along the inner circumferential surface of the lower-end portion of the gear portion 22 and integrally extending from the ratchet tooth-typed cog portion 23*a* to be inclined toward a central axis.

In addition, the responding cog 63 has a shape responding to the cog 23 and may include a ratchet tooth-typed responding cog portion (63*a*) provided along an outer circumferential surface of an upper-end portion having a cylindrical shape of the responding gear portion (62); and a bevel tooth-typed responding cog portion (63*b*) provided along an outer circumferential surface of a lower-end portion having a conical shape of the responding gear portion (62) and extending integrally from a tip of the ratchet tooth-typed responding cog portion (63*a*) to be inclined toward a central axis.

Therefore, the ratchet tooth-typed cog portion 23*a* and the ratchet tooth-typed responding cog portion 63*a* are coupled with each other in correspondence with each other, and at the same time, the bevel tooth-typed cog portion 23*b* and the bevel tooth-typed responding cog portion 63*b* are coupled with each other in correspondence with each other. In this case, the contact area between the cog 23 and the responding cog 63 becomes wider than the contact area in the case where only the ratchet tooth-typed cog portion 23*a* and the ratchet tooth-typed responding cog portions 63*a* are simply coupled, so the frictional force increases, whereby the restraining force acting on the reel part 20 may be maximized. Furthermore, the wear rate of the ratchet gear 34 and the responding ratchet gear 54 may be reduced by sharing the load biased toward the ratchet gear 34 and the responding ratchet gear 54, thereby providing the effect of extending the lifespan.

In addition, as the contact area between the cog 23 and the responding cog 63 is widened, the gear portion 22 and the responding gear portion 62 may be easily separated without interference between the cogs even in a small distance movement when separated.

Figure 4:
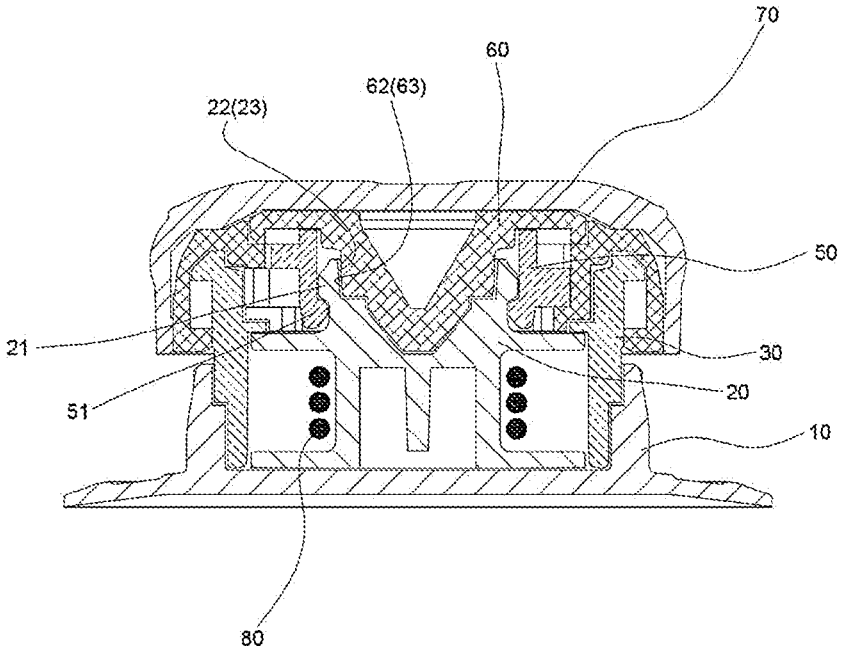
FIG. 4 is a sectional view showing a state in which the reel part and a stopper unit of the dial-type wire tightening device according to the exemplary embodiment of the present disclosure are mutually coupled.
Figure 5:
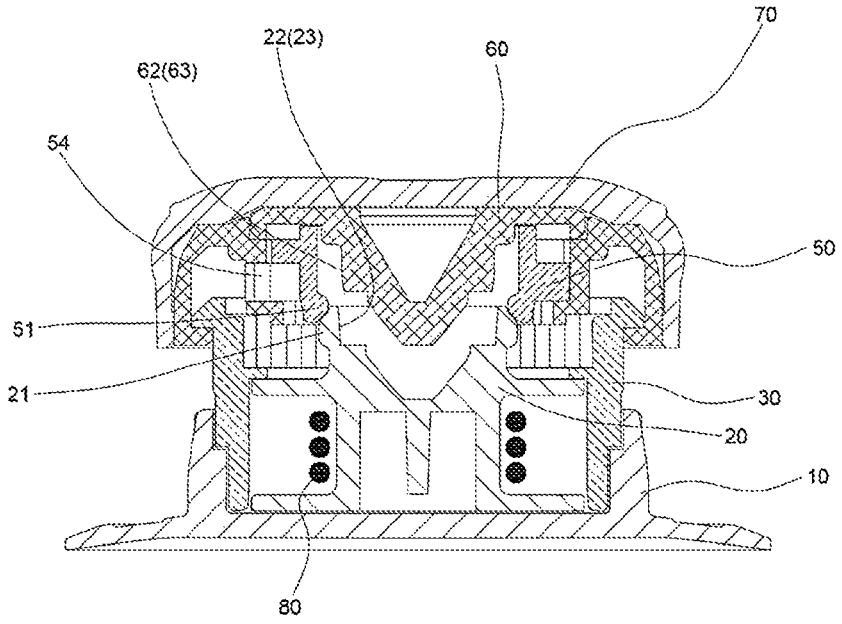
FIG. 5 is a sectional view showing a state in which the reel part and the stopper unit of the dial-type wire tightening device according to the exemplary embodiment of the present disclosure are mutually separated.

FIG. 4 is a sectional view showing a state in which the reel part and a stopper unit of the dial-type wire tightening device according to the exemplary embodiment of the present disclosure are mutually coupled, and FIG. 5 is a sectional view showing a state in which the reel part and the stopper unit of the dial-type wire tightening device according to the exemplary embodiment of the present disclosure are mutually separated.

As shown in FIGS. 4 and 5, in a state where the lower cover 10 is sewn first to the upper of the shoe, the wire tightening device is simply assembled to the shoe as follows: the reel part 20 is mounted in the accommodating groove 16, and the opposite end parts of the knotted wire 80 are inserted into and bound to the lead-out hole (not shown) of the reel part 20; the housing part 30 is inserted into and fixed to the lower cover 10; the intermediate cover 40 in which the stopper unit 50 has been seated is coupled with the top of the housing part 30, wherein the locking piece 51 is caught on the locking step 21 through the central hole 45 so that the reel part 20 and the stopper unit 50 are coupled with each other; at the same time, the responding ratchet gear 54 of the stopper unit 50 is engaged with the ratchet gear 34; then, after being inserted into the gear portion 22 of the reel part 20, the pawl part 60 is coupled to be integral with the intermediate cover 40; and the upper cover 70 is coupled to cover an outer surface of the intermediate cover 40.

To describe the operation method of the wire tightening device assembled in this way, the stopper unit 50 is bound with or separated from the reel part 20 according to the lifting or lowering operation of the intermediate cover 40 to which the upper cover 70 is coupled so as to allow the reel part 20 to wind or unwind the wire 80.

Specifically, first, in the case of winding the wire 80, when the upper cover 70 is pressed downward by force applied externally in a state in which the stopper 52 of the stopper unit 50 is separated from the ratchet gear 34 of the housing part 30, the intermediate cover 40 and pawl part 60 integrally coupled with the upper cover 70 descend, the responding gear portion 62 of the pawl part 60 is inserted into the gear portion 22 of the reel part 20 protruding from the central hole 45 so that the cog 23 becomes to be mutually engaged with the responding cog 63.

In addition, the stopper unit 50 seated in the intermediate cover 40 descends together with the intermediate cover 40 so that the locking piece 51 is pushed down along the outer circumferential surface of the gear portion 22 of the reel part 20 and caught on the locking step 21 by elasticity. As a result, the reel part 20 and the stopper unit 50 are coupled with each other. At the same time, the end of the stopper 52, that is, the responding ratchet gear 54 passes through the opening 47 and is maintained in a state of being engaged with the ratchet gear 34 provided on the inner circumferential edge of the housing part 30 so as to be rotated in one direction.

When the upper cover 70 is rotated in this state, by the rotation of the intermediate cover 40 integrally coupled with the upper cover 70, the responding ratchet gear 54 provided in the stopper unit 50 engages with the ratchet gear 34 of the housing part 30 to rotate in one direction. Accordingly, the reel part 20 coupled with the stopper unit 50 is rotated in one direction together with the stopper unit 50 so that the wire 80 is wound around the outer circumferential surface of the reel part 20. At this time, as the responding gear portion 62 of the pawl part 60 which is integrally coupled with the intermediate cover 40 and the gear portion 22 of the reel part 20 are coupled with each other, the cog 23 and the responding cog 63 are engaged with each other, thereby being maintained to be in a restraining state such that the reel part 20 be rotated in only one direction.

Therefore, when the upper cover 70 is rotated, the wire 80 is continuously wound around the reel part 20 so that the shoe may be tightened by the tensile force. Even when the rotation of the upper cover 70 is stopped in a state in which the wire 80 is tightened, the ratchet gear 34 and the responding ratchet gear 54, and the cog 23 and the responding cog 63 are engaged with each other, respectively, thereby restraining the rotation of the reel part 20 in an opposite direction. Accordingly, the wire 80 wound around the reel part 20 may maintain the tightness thereof in a tense state without being released.

Conversely, when trying to loosen the tensioned wire 80 in order to take off the shoes, the upper cover 70 is pulled upward to raise the intermediate cover 40 integrally coupled with the upper cover 70, and at the same time, while the stopper unit 50 engaged with the ratchet gear 34 and restraining the reel part 20 is also raised along with the intermediate cover 40, the locking piece 51 having elasticity is separated from the locking step 21. Accordingly, not only the binding between the stopper unit 50 and the reel part 20 is released but also the ratchet gear 34 and the responding ratchet gear 54 are separated so that the restraining state of the reel part 20 is released.

In addition, as the pawl part 60 integrally coupled with the intermediate cover 40 is also raised together with the intermediate cover 40, the responding gear portion 62 is separated from the gear portion 22, and the binding of the cog 23 and the responding cog 63 is released and the state of restraining the reel part 20 to be rotated in one direction is completely released, so that the rotation of the reel part 20 is freed. Accordingly, when one side of the wire 80 is pulled, the wire 80 wound around the reel part 20 is released and the tightening is loosened.

Figure 6A:
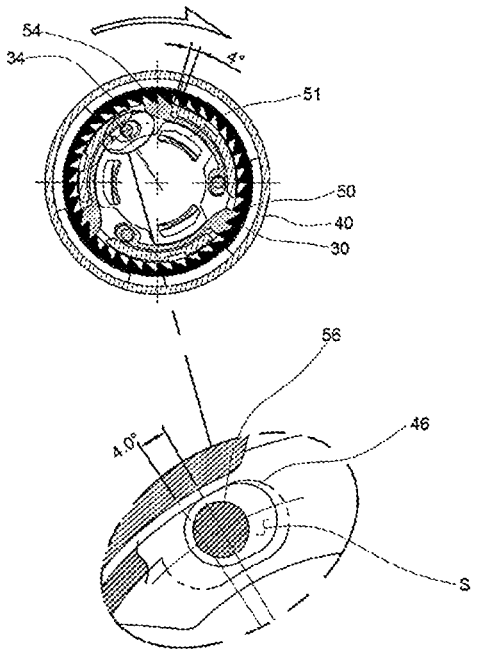
FIGS. 6A and 6B show plan views showing states in which a stopper unit according to the exemplary embodiment of the present disclosure is coupled with an intermediate cover.
Figure 6B:
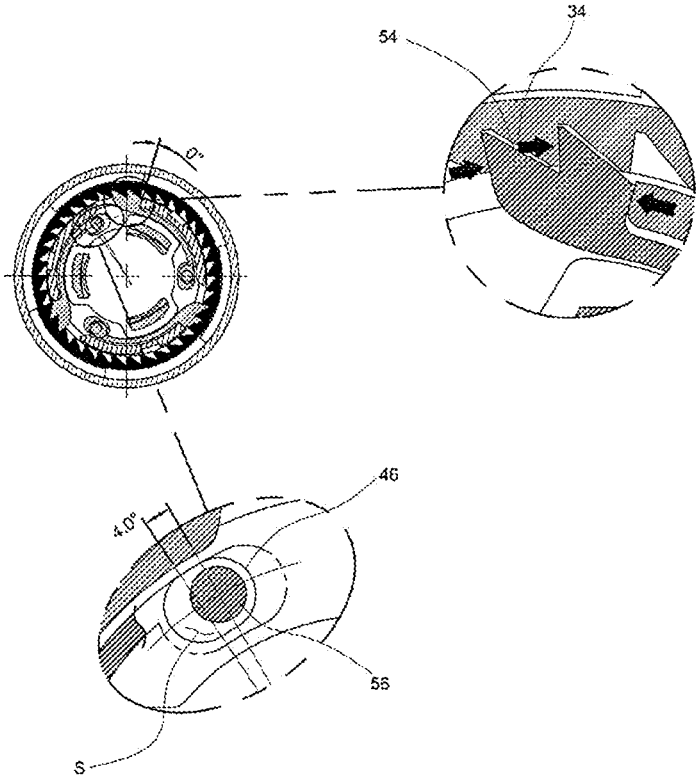

FIGS. 6A and 6B show plan views showing states in which a stopper unit according to the exemplary embodiment of the present disclosure is coupled with an intermediate cover.

As shown in FIGS. 6A and 6B, the stopper unit (50) is provided with a shaft bearing (56) protruding downward at the lower-end portion thereof, and the intermediate cover (40) is provided with a shaft hole (46) coupled with the shaft bearing (56) on a lower surface of the seating groove (44) thereof. At this time, the shaft hole (46) has a long hole shape in which a clearance (S) is provided between it and the shaft bearing (56) so that the stopper unit (50) may move minutely in a clockwise or counterclockwise direction.

In the case of rotating the upper cover 70 to tighten the wire 80, when the stopper 52 is located on the mountain portion of a cog of the ratchet gear 34 in a process that the responding ratchet gear 54 of the stopper 52 is engaged with a cog of the ratchet gear 34 while moving in and out of the valley and mountain of a cog of the ratchet gear 34 through the opening 47, the stopper 52 may be pushed back by elasticity and thus engaged with a cog of the ratchet gear 34 located behind a cog of the ratchet gear 34 which is a target to be engaged with, so a case may occur so that desired tightening force may not be obtained at one time.

Therefore, the shaft hole 46 of the intermediate cover 40 coupled with the shaft bearing 56 of the stopper unit 50 has a long hole shape, whereby clearance S is provided between the shaft hole 46 and the shaft bearing 56. Accordingly, extra time is provided so that the responding ratchet gear 54 of the stopper 52 may be precisely engaged in the right position while finely moving in the left and right directions, that is, clockwise or counterclockwise so as to allow the wire 80 to be tightened with the tightening force of a desired strength.

In addition, as a fine movement of the stopper unit 50 becomes possible by the clearance S provided between the shaft hole 46 and the shaft bearing 56. Accordingly, there may provide the effect of resolving the problem that the engagement state of the responding ratchet gear 54 of the stopper 52 and the ratchet gear 34, which are engaged with each other at the same position, may deteriorate due to wear occurring from the prolonged use of the wire tightening device.

On the other hand, the dial-type wire tightening device according to the preferred embodiment of the present disclosure, of course, may be carried out in various items that tighten the wire or straps such as hats, bags, gloves, and the like.

Although the embodiment of the present disclosure has been described with reference to the above and attached drawings, a person with common knowledge in the technical field in which the present disclosure belongs may understand that the present disclosure will be able to be implemented in another concrete form without changing the technical ideas or essential characteristics. Therefore, the embodiments described above should be understood as exemplary and not limiting in every way.

What is claimed is:

1. A dial-type wire tightening device, comprising:

a lower cover provided with a plate-shaped support plate and provided with an accommodating groove, wherein the accommodating groove is provided in a central portion by a support wall body, the support wall body is provided to extend vertically from an upper surface of the plate-shaped support plate;

a reel part provided with a gear portion installed in a circle having a cog of a two-stage structure on an inner circumference edge at an upper-end portion, allowing a wire to be wound along an outer circumference edge when rotating by being rotatably installed inside the accommodating groove;

a housing part having a lower-end portion coupled and fixed to the accommodating groove, accommodating the reel part in the housing part and provided with a ratchet gear along an inner circumference edge of an upper-end portion;

an intermediate cover, wherein the intermediate cover is provided with a coupling groove provided to be recessed upward from a lower surface to allow the upper-end portion of the housing part to be fixedly inserted into the coupling groove and a seating groove, wherein the seating groove is provided to be recessed downward from an upper surface, wherein a central hole is provided at a central portion of the seating groove, wherein the gear portion passes through the central hole, and an opening is provided by opening a portion of an inner circumferential surface of the seating groove;

a stopper unit, wherein the stopper unit is provided with a stopper coupled with an outer circumferential surface of the gear portion and radially branched off to have elasticity from the outer circumferential surface of the gear portion and a responding ratchet gear, wherein the responding ratchet gear is provided at a tip of the stopper to be engaged with the ratchet gear through the opening, providing a primary restraining force, wherein the reel part rotates in one direction, wherein the gear portion has a lower-end portion exposed through the central hole by being seated on the seating groove;

a pawl part coupled with an upper-end portion of the intermediate cover and provided with a responding gear portion, wherein the responding gear portion is configured to be inserted into the gear portion, providing a secondary restraining force, wherein the reel part rotates in one direction, wherein the responding gear portion has a responding cog of a two-stage structure configured to be engaged with the cog and is installed to protrude downward; and an upper cover coupled with the intermediate cover while wrapping around an outside of the intermediate cover, thereby being rotated integrally with the intermediate cover by a rotational force applied from the outside.

2. The dial-type wire tightening device according to claim 1, wherein the responding cog comprises:

a ratchet tooth-typed responding cog portion provided along an outer circumferential surface of an upper-end portion having a cylindrical shape of the responding gear portion; and a bevel tooth-typed responding cog portion provided along an outer circumferential surface of a lower-end portion having a conical shape of the responding gear portion and extending integrally from a tip of the ratchet tooth-typed responding cog portion to be inclined toward a central axis.

3. The dial-type wire tightening device according to claim 1, wherein the reel part is provided with foreign material discharge holes radially disposed with respect to a virtual central axis at a lower-end portion, discharging a foreign material deposited on the wire along a rotation in one direction of the reel part.

4. The dial-type wire tightening device according to claim 1, wherein a locking step is provided at the upper-end portion of the reel part, wherein the locking step is provided to protrude along an outer circumferential surface, and a locking piece is provided at a lower-end portion of the stopper unit, wherein the locking piece extends downward but has a bent end portion, wherein the locking piece moves up and down while being rubbed against the locking step, wherein a coupling and separation of the stopper unit and the reel part is confirmed.

5. The dial-type wire tightening device according to claim 1, wherein the stopper unit is provided with a shaft bearing protruding downward at the lower-end portion the shaft bearing, and the intermediate cover is provided with a shaft hole coupled with the shaft bearing on a lower surface of the seating groove of the intermediate cover, wherein the shaft hole has a long hole shape, wherein a clearance is provided in the long hole shape between the shaft hole it and the shaft bearing, wherein the stopper unit may move minutely in a clockwise or counterclockwise direction.

6. The dial-type wire tightening device according to claim 1, wherein the lower cover is provided with at least one sewing guide groove to allow an accurate sewing to be performed along an edge of the plate-shaped support plate.

* * * * *